United States Patent [19]

Hsu

[11] 4,232,242

[45] Nov. 4, 1980

[54] SPARKING PLUG WITH EFFICIENT AIR SUPPLYING SYSTEM AND A REMOVABLE SITTING DEVICE

[76] Inventor: Yun T. Hsu, 30-27, Chun In Rd., Chun In Village, Tong Sun Hsiang, I Lan Hsien, Taiwan

[21] Appl. No.: 931,727

[22] Filed: Aug. 7, 1978

[51] Int. Cl.[2] ..... H01T 13/02; H01T 13/06

[52] U.S. Cl. ..... 313/120

[58] Field of Search ..... 313/120, 118

[56] References Cited

U.S. PATENT DOCUMENTS

| | | | |
|---|---|---|---|
| 870,369 | 11/1907 | Lamkin | 313/120 |
| 1,327,382 | 1/1920 | Garber | 313/120 X |
| 1,384,818 | 7/1921 | Bathurst | 313/120 |
| 1,552,775 | 9/1925 | Thomas | 313/120 X |
| 1,771,400 | 7/1930 | Daubenspeck | 313/120 X |

*Primary Examiner*—Robert Segal

*Attorney, Agent, or Firm*—Cushman, Darby & Cushman

[57] ABSTRACT

A spark plug including an air supplying system which supplies enough air to an internal-combustion engine to promote the required degree of combustion of the fuel in the engine and produces little carbon which might block the ventilation of air. The air supply system includes a removable filtering device for eliminating dust.

6 Claims, 6 Drawing Figures

Fig. 2.
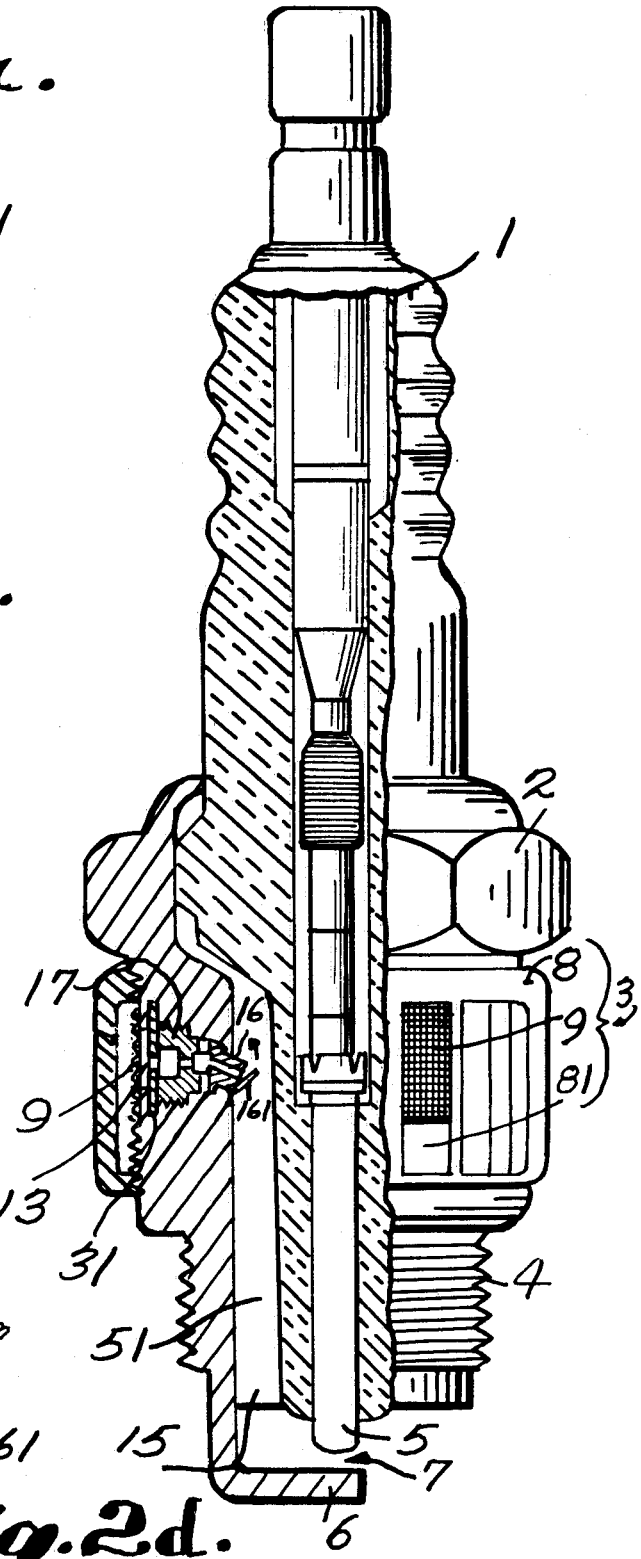
Fig. 2a.
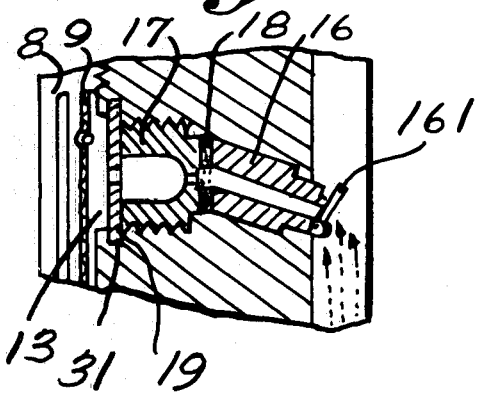
Fig. 2b.
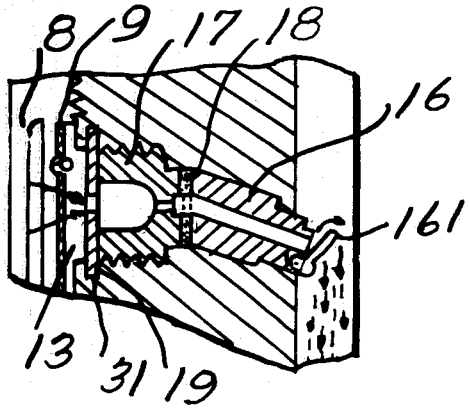
Fig. 2c.
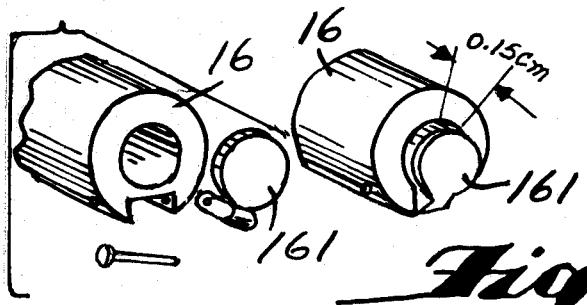
Fig. 2d.

SPARKING PLUG WITH EFFICIENT AIR SUPPLYING SYSTEM AND A REMOVABLE SITTING DEVICE

BACKGROUND

Conventional spark plugs are designed for providing a spark to ignite a gas in a cylinder of an engine. The gas is a fuel-air mixture, the fuel coming from a gasoline tank, and the air coming from a spacing washer intermediate between the casing thread of the spark plug screwed into the cylinder head of the engine, and through a very small aperture formed between the closely screwed threads of the plug casing, through the engine cylinder, and into the engine. The entry of air by the way described above makes possible blockage of the air ventilation when some dust attaches in the aperture. Such a blockage of air ventilation results in a lack of air assistant to the engine which reduces the degree of combustion to a very low level. Another known type of spark plug, has an air chamber formed between a medium body part of the plug and an outer surounding iron sheath wich is ventilated with lattice openings, inside of which a mesh put around the chamber operates as an air filling device. Some and small hollows are bored through the bottom of the chamber to the casing thread (which thread is for screwing the plug into cylinder head of an engine). Air therefore can pass through the ventilated iron sheath and through the mesh (for filtering purposes) to the air chamber and then converts to flow through the bottom hollows to the aperture of the screwed together threads (when the plug is already screwed into the engine in order) to the cylinder of the engine to mix with the fuel. The entry of the air by this route may keep out dust which blocks the aperture of the screwed threads, but the aperture is nevertheless very small and whenever some carbon pearls are produced in engine they might block the passage of the air and cause combustion to deteriorate.

SUMMARY OF THE INVENTION

The present invention unit is more similar to the conventional spark plug than the air chamber one, except that it it ventilates the chamber to an air tunnel and extends the tunnel straight downward to open at the end of the plug which is directly inside the cylinder of the engine when the plug is screwed in place, and therefore air no more passes the very closed aperture of the screwed threads which may be easily blocked by dust or carbon pearls. The present invention also provides a device for preventing reversed exhaust gas from flowing out from the air supplying system to the atmosphere. An inlet manifold placed right behind the inlet entry hole of the air tunnel functions to control the air flow.

Morever, the present invention possesses a mesh filter fixed inside and around the air chamber for air filtering purposes. This mesh filter is removable and convenient for eliminating dust. The main objects of the present invention are to provide an air supplying system supplying enough mass air to assist the combustion of fuel in the engine, to provide an efficient filtering device maintaining the system in ventilation for a longer period of time and both the air supplying system and the filtering device being removable for eliminating dust or replacement as necessary.

BRIEF DESCRIPTION OF THE DRAWINGS

Other objects and functional and structural features of the invention will appear from the following detailed specification taken with the accompanying drawing wherein.

FIG. 2, FIG. *2a*, FIG. *2b*, FIG. *2c* and FIG. *2d* are cut away views of the invention showing the disposition and the structure of the main elements.

DETAILED DESCRIPTION OF THE INVENTION

Figure 1:
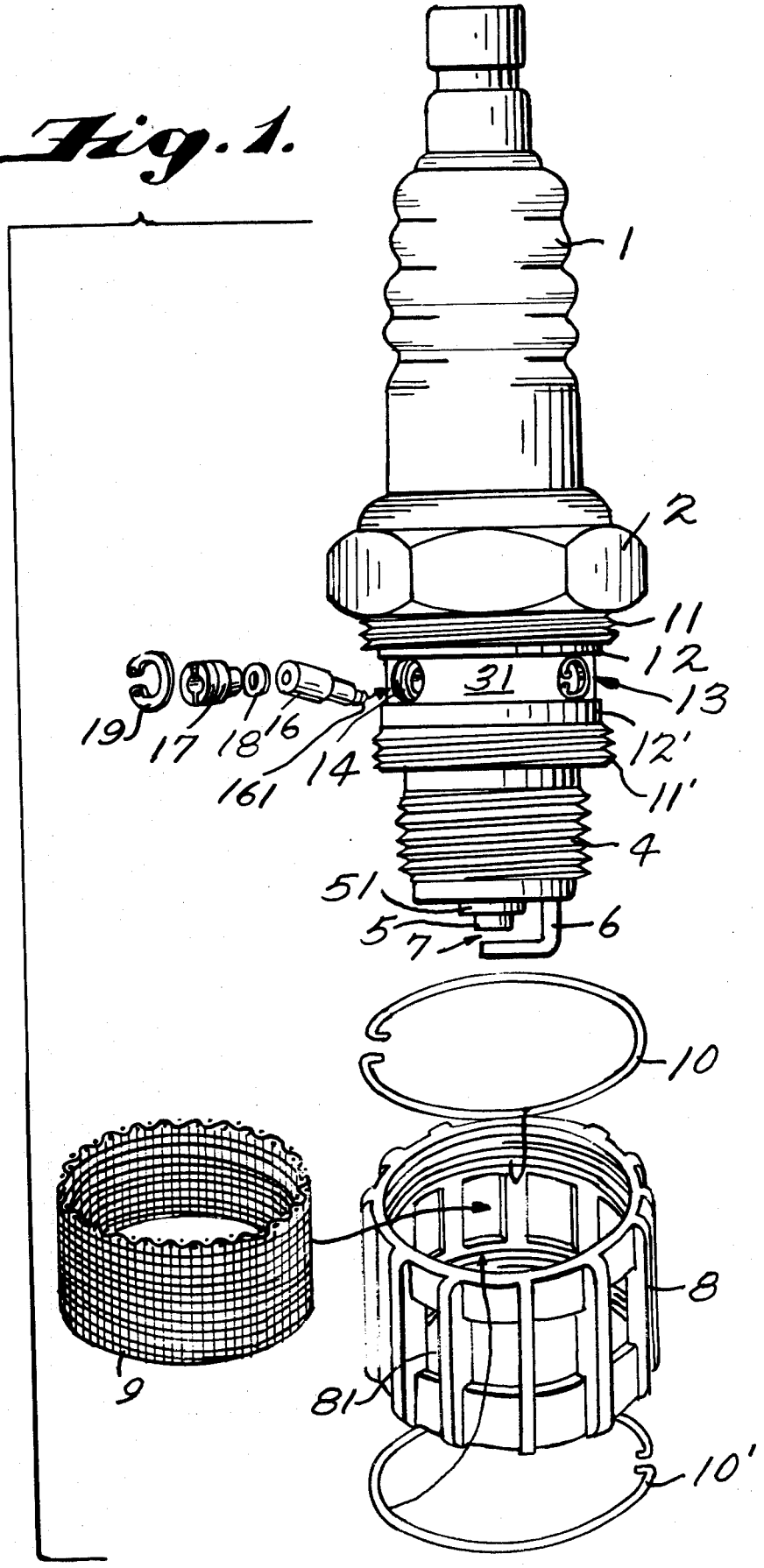
FIG. 1 is a perspective view of the invention partly pull out.

The present invention includes the following elements normally found on a conventional spark plug: a terminal nut 1, a hexagonal screw cap 2, a medium body part 3, a casing thread 4, a center conductor 5, a prong 6 and a spark gap (or air gap) 7. The end terminal of the center conductor 5 as the inner electrode and the extended inward prong 6 acts as the outer electrode (which always is grounded to the engine block). The present invention differs from the conventional spark plug by certain modifications of the medium body part 3 which achieve the objects of the invention.

When iron sheath 8 is screwed onto threads 11 & 11' around the medium body part 3, a space between the iron sheath 8 and the medium body part 3 is formed as a air chamber 13. Air chamber 13 is bounded from above and below by ground outside round parts 12 & 12'. Mesh 9 fixed inside and around the iron-clad 8 (or inside the chamber 13) acts as an air filter. Several holes 14 are bored in the wall 31 of the medium body part 3 for drawing air into a tunnel 15. Tunnel 15 is formed between a center ceramic insulator 51 and the medium body wall 31. The tunnel 15 opens straight downward to the lower end of the plug. A similar vacancy valley around the center ceramic insulator of a conventional spark plug does not open through to middle body wall to connect the inlet hole 14, and therefore do not concern any air tunnel means. But in the present invention, the air tunnel 15 acts as the most important element for directly supplying enough mass air to assist the combustion of the fuel in an engine. The present invention not only provides an air tunnel 15 for supplying enough mass air to the engine, it also provides a device for preventing gas from blowing reversely through the supplying system to the atmosphere. For purposes of discussion the inlet holes 14 of the present invention can be divided into two parts: an inner part declined inward a certain degree for receiving an inner barrel 16, and an outer part of the hole 14 horizontally bored and threaded for receiving a threaded outer barrel 17. Between inner barrel 16 and outer barrel 17, a washer 18 serves as a packing and a connector for conducting air ventilation of between the two barrels 16 & 17.

One ring spring 19 resides around the port of the inlet hole 14 for pushing and keeping both barrels 16 & 17 firmly inside the inlet hole 14. The outer end of the inner barrel 16 is slanted so as to securely match the washer 18 so that the inner barrel 16 itself will unlikely be turnable or rotatable. In this way an inlet manifold 161 can be securely pivoted at the inner end of the inner barrel 16 and the manifold 161 kept facing upward when air is flowing inwardly through the inner barrel 16. A securely unturnable inner barrel 16 is very important to the invention, for the inlet manifold 161 must be pivoted to face upward to keep the "inlet" purpose. If the inner barrel 16 is turnable, then the manifold 161 might be turned into facing downward by any vibration of the car (or vessel)and therefore unable to close itself by exhaust gas. Pivoting of the inlet manifold 161 means pivoting the manifold 161 on the lower edge of the inner end of the inner barrel 16. In this orientation the manifold 161 can be opened facingly upward. Barrels 16 & 17 can have any in a range of inner diameters as may be required for different air requirements of different engines. For example if, an overrun engine is weak in the induction of gas, barrels 16 and 17 can be replaced with barrels 16 and 17 with larger inner diameters so as to have a large enough hole to supply an adequate mass of air. The present invention barrels 16 & 17 are removably secured in the spark plug so they can be removed and replaced easily and conveniently. The medium body wall 31 is surounded with an iron sheath 8, iron sheath 8 having lattice openings 81 to serve as the initial entry-ports of air.

A mesh 9 fixed inside and around the iron sheath 8 by elastic washers 10 & 18' operates as a filter for cleaning the passing air. The iron sheath 8 and the mesh filter 9 of the present invention are also removable. The advantages of the present invention described hereto before can be summarized as follows.

(1) The present invention air supplying system can supply an adequate volume of entry air which an engine requires.

(2) The present invention air filtering device functions efficiently for air cleaning.

(3) The present invention air supplying system provides a direct air flow passage to the engine which reduces blockage of the passage of air.

(4) The hollow portion of the air barrels of the present invention can varied according to the be induction ability of the engine or mixing rate of fuel being used.

(5) The present invention air inlet manifold will efficiently prevent the reversed flow of from the air supplying system.

(6) The present invention increases the degree combustion of the air-fuel mixture and produces only little carbon pearls so as to increase the durability of the engine.

I claim:

1. A spark plug comprising:

a central ceramic insulator holding an electrode; said electrode extending to an end terminal;

a medium body portion surrounding said insulator; an annular air tunnel terminating at said end terminal being formed between said medium body portion and said insulator;

a protection sheath surrounding said medium body portion so as to form an annular air chamber between said sheath and said medium body portion, said sheath having openings therein for receiving air into said chamber;

a plurality of holes formed in said medium body portion each extending from said air chamber to said tunnel;

a cylindrical mesh filter within said protection sheath for filtering air to said plurality of holes; and a plurality of unidirectional flow inlet valves, one each received in each of said holes for directing air flow between said chamber and said tunnel toward said end terminal.

2. A spark plug as in claim 1 wherein said unidirectional inlet valves each include a hollowed threaded outer barrel and, a hollowed inner barrel having a portal at the inner end thereof, said spark plug further comprising a first washer, and a spring washer, wherein said medium body wall includes an inner part and an outer part, said barrel receiving holes each comprising a threaded outer horizontal part formed in said medium body wall outer part and having a portal at the outer surface thereof, and an inwardly downward sloping inner part opening at opposite ends thereof at said outer part and said air tunnel, said threaded horizontal part receiving said threaded outer barrel, said inner sloping part receiving said inner barrel, said inner barrel being insertable into said inner sloping part through said outer horizontal part, said washer being removably disposed in said horizontal part between said outer threaded barrel and said inner barrel, said spring washer surrounding said outer part portal and keeping said threaded outer barrel and said inner barrel respectively firmly inside said outer horizontal part and said inner sloping part to effectively serve air flow control.

3. A spark plug as shown in claim 2 further comprising a plurality of inner and outer second hollowed barrels having different sized center hollows for being replaced in said barrel receiving holes to satisfy different requirements of air flow, for different requirements of the rates of fuel-air mixture, according to the different abilities of the air induction of said engines.

4. A spark plug as in claim 2 wherein each said inner barrel has a sloped end for closely leaning against said first washer placed between the inner barrel and the outer barrel for keeping the inner barrel itself unturnable in said hole, having its opposite end in said tunnel, and having an inlet manifold pivotally mounted to the end thereof for preventing flow of air out from the barrel to the atmosphere, said slopped end of the inner barrel being wholly closed onto the washer and making the barrel itself unclosable from vibrations of any car or vessel on which it may be mounted.

5. Spark plug as claimed in claim 4 wherein said closable portal comprises a cap pivotally mounted to the bottom portion of the inside end of the inner barrel inside the air tunnel, so that whenever said engine is in its induction state the cap will pivot downward to open and enable air flow into the air tunnel, and when the engine is in its exhaust state said cap will pivot upward to close and prevent gas flow out from the inner barrel to the atmosphere.

6. A spark plug as in claim 1 wherein said mesh filter includes two spring rings to fix the mesh against the inner surface of said iron sheath, so that said mesh may be easily removed from said iron sheath for removing dust therefrom.

* * * * *